US007322713B2

(12) United States Patent
Morrow

(10) Patent No.: US 7,322,713 B2
(45) **Date of Patent: *Jan. 29, 2008**

(54) GRIPPING TOOL

(75) Inventor: David L. Morrow, Chester, CT (US)

(73) Assignee: Ben Hughes Communication Products Co., Chester, CT (US)

( * ) Notice: Subject to any disclaimer, the term of this patent is extended or adjusted under 35 U.S.C. 154(b) by 11 days.

This patent is subject to a terminal disclaimer.

(21) Appl. No.: 11/240,920

(22) Filed: Sep. 30, 2005

(65) Prior Publication Data

US 2006/0107796 A1 May 25, 2006

Related U.S. Application Data

(63) Continuation-in-part of application No. 10/982,342, filed on Nov. 4, 2004.

(60) Provisional application No. 60/517,005, filed on Nov. 4, 2003.

(51) Int. Cl.
*B25B 23/18* (2006.01)

(52) U.S. Cl. ..... 362/120; 362/119; 362/253

(58) Field of Classification Search ..... 362/119–120
See application file for complete search history.

(56) References Cited

U.S. PATENT DOCUMENTS 4,802,390 A * 2/1989 Warheit ..... 81/341
6,296,365 B1 * 10/2001 McCalla et al. ..... 362/119
6,473,925 B1 * 11/2002 Konen ..... 7/107

* cited by examiner

*Primary Examiner*—Ali Alavi
(74) *Attorney, Agent, or Firm*—Michaud-Duffy Group LLP

(57) ABSTRACT

The present invention is directed to a gripping tool for installing and removing a connector. The gripping tool includes a first body member and a second body member. The first body member defines a first jaw portion and a first handle portion. The first jaw portion includes a first tip. The second body member defines a second jaw portion and a second handle portion. The second jaw portion includes a second tip. The first and the second handle portions are coupled to one another at distal ends for pivoting movement about an axis between an open position and a gripping position. The first and second tips include gripping means for securely engaging the connector positioned between the first and second jaw portions in response to the first and second body members being moved from the open position to the gripping position.

20 Claims, 5 Drawing Sheets

GRIPPING TOOL

CROSS-REFERENCE TO RELATED APPLICATIONS

This application is a continuation-in-part of U.S. patent application Ser. No. 10/982,342, filed Nov. 4, 2004, which claims benefit to U.S. Provisional Patent Application Ser. No. 60/517,005, filed Nov. 4, 2003. The disclosures of these U.S. patent documents are incorporated by reference herein in their entireties.

BACKGROUND OF THE INVENTION

Often equipment today, particularly electronic and telecommunications equipment requires the use of a great many cable connections. These connections typically require that some sort of terminal be plugged into a mating receptacle. The connections are generally closely packed making it difficult for a person to make the connections by hand. Conventional tools such as, for example, pliers and the like, are used to hold the terminal and to guide it to the receptacle. Depending on the environment, the tools are not configured to fit into the narrow spaces between the connection points. As such, even when using conventional tools, achieving reliable connections is difficult.

Accordingly, there exists a current need for a tool that provides a user with the ability to make the above-described connections with little difficulty. It is the general object of the present invention to provide a gripping tool that improves upon or overcomes the problems and drawbacks associated with the prior art.

SUMMARY OF THE INVENTION

The present invention is directed to a gripping tool for installing and removing a connector. The gripping tool includes a first body member and a second body member. The first body member defines a first jaw portion and a first handle portion. The first jaw portion includes a first tip. The second body member defines a second jaw portion and a second handle portion. The second jaw portion includes a second tip. The first and the second handle portions are coupled to one another at distal ends for pivoting movement about an axis between an open position and a gripping position. The first and second tips include gripping means for securely engaging the connector positioned between the first and second jaw portions in response to the first and second body members being moved from the open position to the gripping position.

In one embodiment, the first and the second jaw portions extend from the respective first and second handle portions in a tapered fashion. In one embodiment, the gripping means of at least one of the first and the second tips includes a serrated surface. In another embodiment, one of the first and second tips includes a slot extending from an end of the jaw portion for receiving a portion of the connector. In one embodiment, the first and second tips are removable from the first and second jaw portions. In one embodiment, at least one of the first and the second jaw portions further includes a recess portion in proximity to one of the first and the second tips. The recess portion receives features of the connector such that the first and the second tips securely hold the connector without interference from the features.

In one embodiment, a light source is positioned between and retained by at least one of the first and second body portions and is directed toward the first and second jaw portions to illuminate an object positioned there between. In one embodiment, the light source is a pen light removably interposed between the first and the second body members.

BRIEF DESCRIPTION OF THE DRAWINGS

Identically labeled elements appearing in different ones of the above-described figures refer to the same elements but may not be referenced in the description for all figures.

DETAILED DESCRIPTION OF THE PREFERRED EMBODIMENTS

Figure 1:
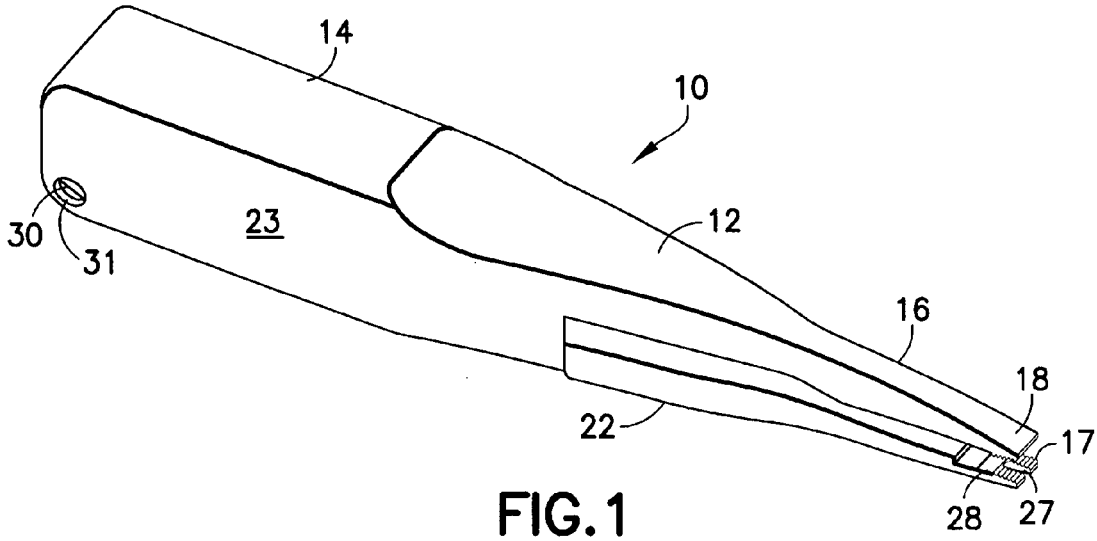
FIG. 1 is a perspective view of the gripping tool of the present invention.
Figure 6:
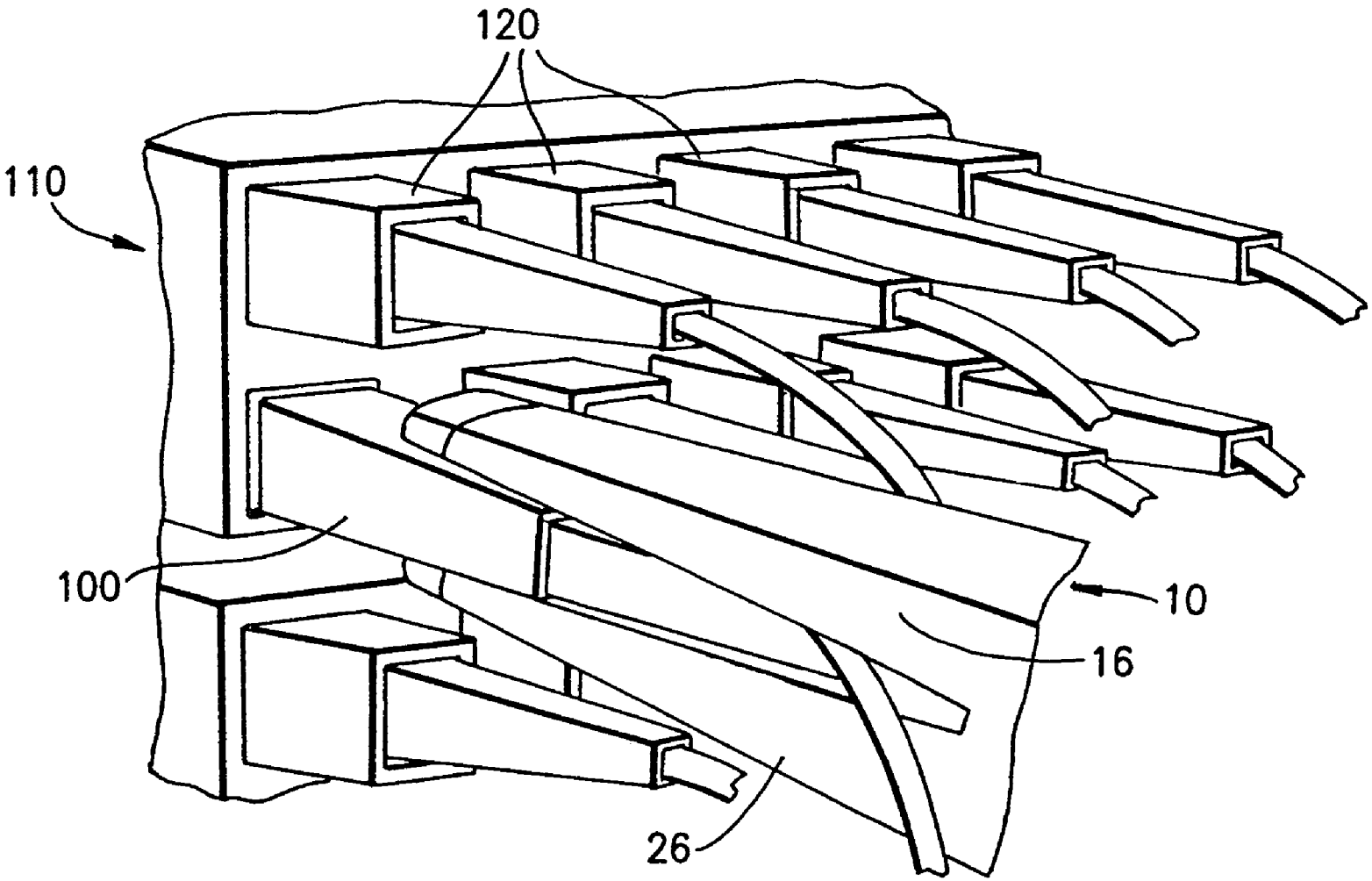
FIG. 6 illustrates use of the gripping tool of the present invention to install a connector in an equipment panel.

FIG. 1 illustrates a gripping tool, generally designated at 10, configured and operating in accordance with the present invention for gripping, holding, installing and removing connectors such as, for example, electronic or telecommunication equipment connectors, into mating receptacles. The gripping tool 10 has a first body member 12 and a second body member 22. The first body member 12 has a handle portion 14 and a jaw portion 16. The jaw portion 16 includes a tip 18. Likewise, the second body member 22 has a handle portion 24 and a jaw portion 26. The jaw portion 26 includes a tip portion 28. In one embodiment, the jaw portions 16 and 26 extend from the respective handle portions 12 and 24 in a tapered fashion to improve access to difficult to reach areas such as, for example, densely populated equipment panels and to minimize inadvertent contact with adjacent connections. For example, FIG. 6 depicts use of the gripping tool 10 to insert a connector 100 in a densely populated equipment panel, shown generally at 110. As illustrated in FIG. 6, the tapered jaw portions 16 and 26 allow the connector 100 to be installed in the equipment panel 110 without disturbing adjacent connectors 120 that are already installed in the panel 110. The tapered jaw portions 16 and 26 similarly assist removal of connectors 100 and 120 in such a tight space. It should be appreciated that it is desirable to not disturb adjacent connectors so as not to interrupt service on the adjacent channels.

Figure 7A:
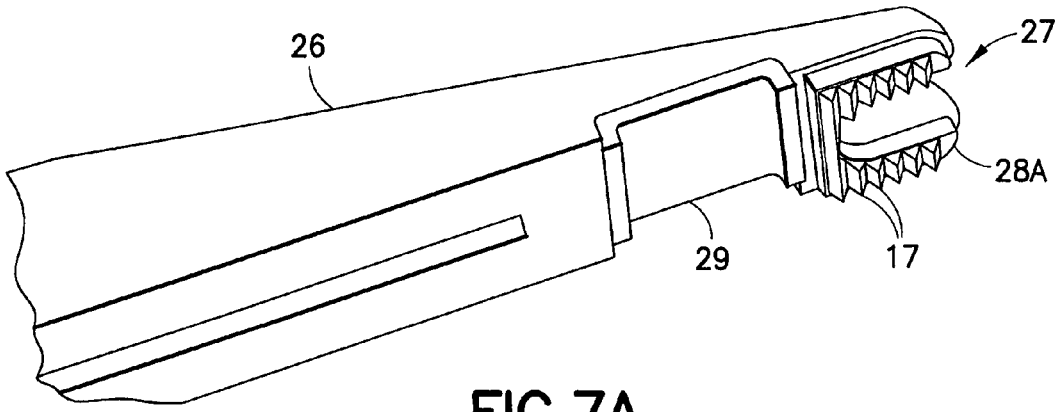
FIGS. 7A and 7B are enlarged prospective views of jaw portions of the first and second body members of the gripping tool of the present invention.
Figure 7B:
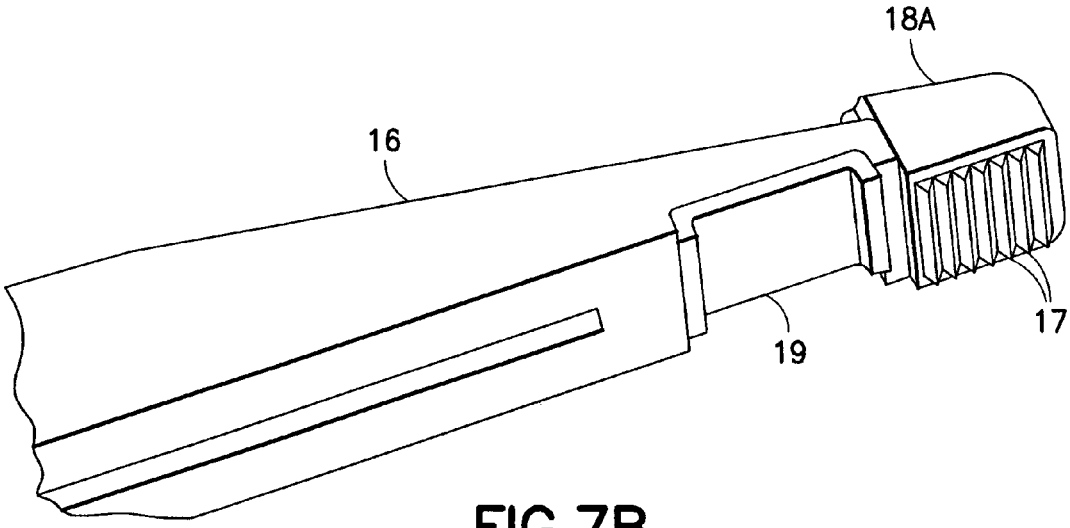

In one embodiment, the first and second body members 12 and 22, respectively, are formed from a dielectric material such as, for example, a plastic, so that the gripping tool 10 does not conduct electric current or create sparks when contacting metal objects. It should be appreciated, however, the present invention is not limited in this regard as ceramic, metals or other materials may also be used to form the first and second body members 12 and 22. In addition, while tips 18 and 28 of the jaw portions 16 and 26, respectively, are shown in one embodiment (FIGS. 1-5) as being integrally formed with the first and second body members, 12 and 22 respectively, it should be appreciated that the present invention is not limited in this regard as the tips 18 and 28 of the jaw portions 16 and 26 may be removable to accommodate different configurations adapted to perform different tasks. For example, in FIGS. 7A and 7B, the tips 18 and 28 are replaced with removable tips 18A and 28A. One perceived advantage of the removable tips 18A and 28A is that a new or alternate pair of tips can be provided as a previous pair are worn, damaged, or if a differing configuration of tips is better suited for a particular task.

Figure 2:
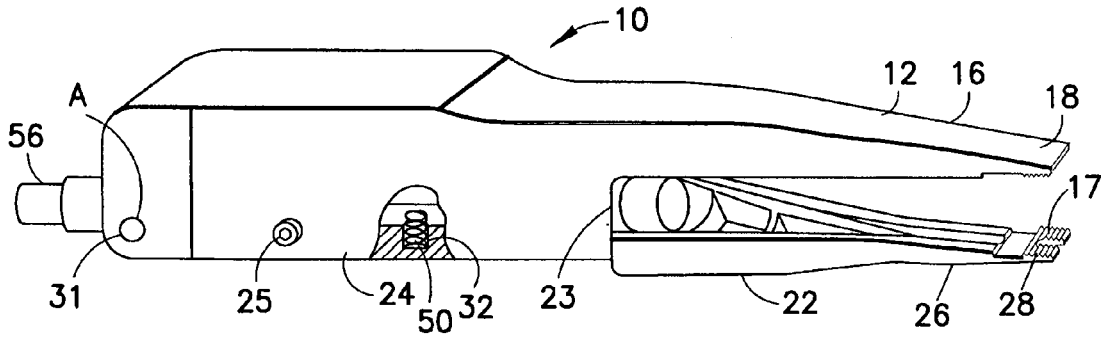
FIG. 2 is a perspective view of the gripping tool of the present invention showing a pen light positioned between body members of the gripping tool.
Figure 3:
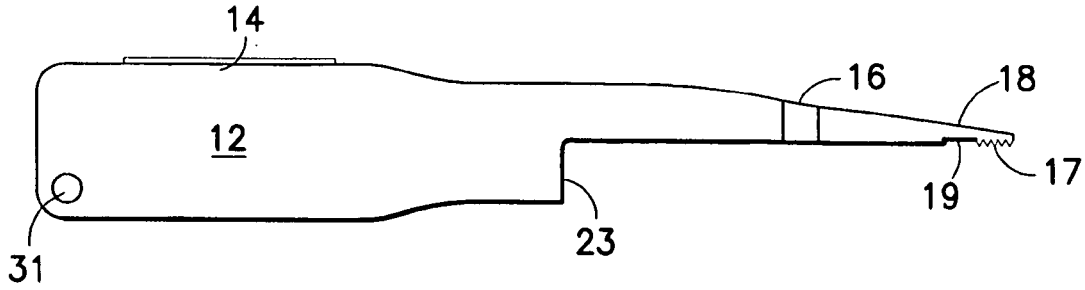
FIG. 3 is a side view of a first body member that forms part of the gripping tool of the present invention.

In FIG. 2, the gripping tool 10 is shown in an open position wherein the jaw portion 16 of the first body member 12 is spaced away from the jaw portion 26 of the second body member 22. In FIG. 1, the gripping tool 10 is shown in a gripping position with the first and second jaw portions, 16 and 26 respectively, are in a semi-closed position such that an object (e.g., a connector) is grasped and held securely there between. In one embodiment, the first body member 12 defines a skirt portion 23 that overlaps a portion of the second body member 22 during movement of the gripping tool 10 between the open and the gripping positions.

Figure 4:
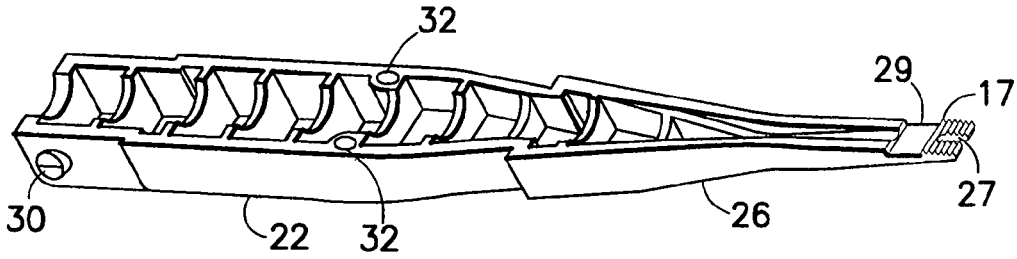
FIG. 4 is a perspective view of a second body member that forms part of the gripping tool of the present invention.
Figure 5:
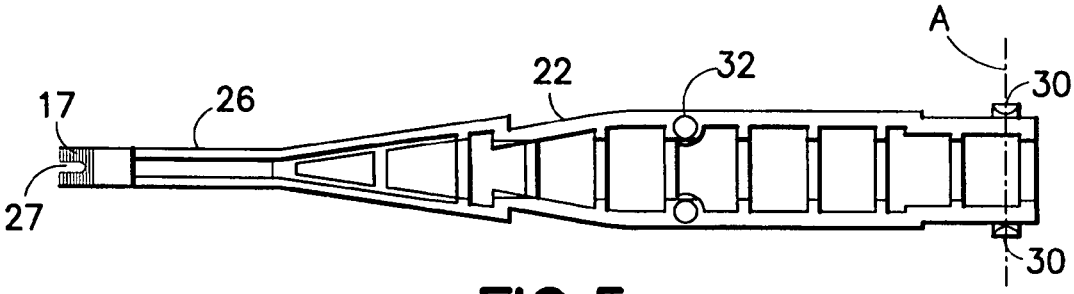
FIG. 5 is a top view of the second body member of FIG. 4.

As shown in FIGS. 4 and 5, the second body member 22 defines a pair of generally opposed, outwardly projecting pins 30. The pins 30 are adapted to be pivotally received in generally opposed apertures 31 (FIG. 3) defined by the handle portion 14 of the first body member 12 thereby joining the first and second body members 12 and 22, respectively, together and allowing pivotal rotation between the open and gripping positions about an axis A. The first and second body members 12 and 22, respectively, are normally urged toward the open position by at least one spring 50 disposed in an aperture 32 of the second body member 22 and interposed between the first and second body members 12 and 22, respectively.

Figure 8A:
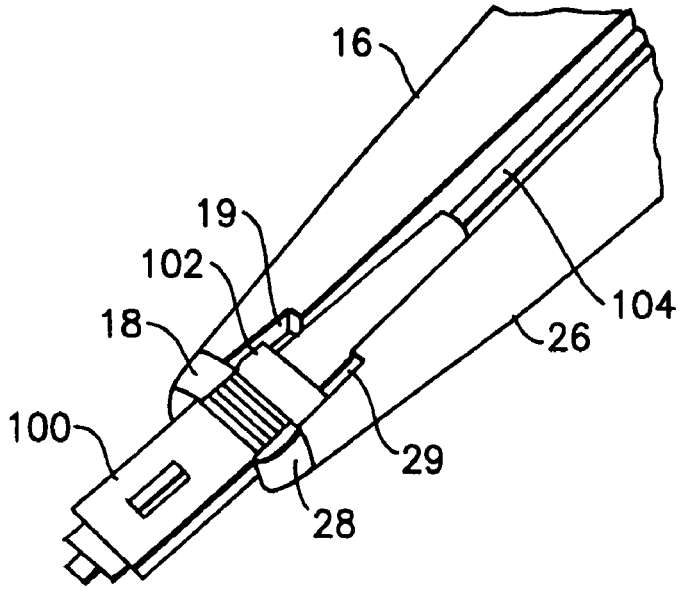
FIGS. 8A and 8B are enlarged prospective views illustrating use of the gripping tool of the present invention gripping and holding various connectors prior to installation and/or removal.

In accordance with the present invention, the tips 18, 18A, 28 and 28A of the first and second jaw portions 16 and 26, respectively, each include raised portions or serrations 17 to facilitate the gripping and holding of objects. In one embodiment, illustrated in FIGS. 7A and 7B, the first and the second jaw portions 16 and 26 each include a recess portion 19 and 29, respectively. As shown in FIG. 8A, the recess portions 19 and 29 accommodate features of connectors such as, for example, a shoulder 102 of connector 100, so that the connector 100 is securely held by the tips 18 and 28. It should be appreciated that the tapered jaw portions 16 and 26 accommodate a fiber cable 104 extending from the connector 100 so as not to place undo stress on the cable 104 during insertion or removal of the connector 100 from an equipment panel.

Figure 8B:
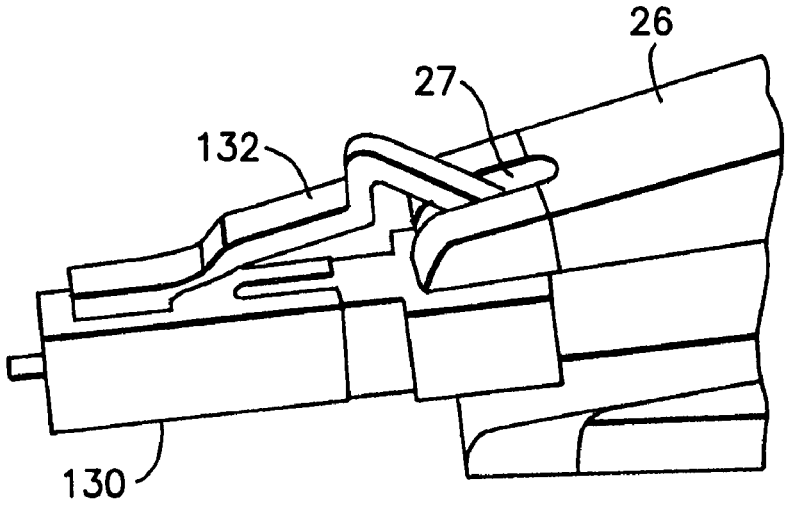

In one embodiment, the tips 28 and 28A of the second jaw portion 22 each define a slot 27. The slot 27 is adapted to accommodate a portion of a connector, such as, for example, a depressible tab 132 on a standard telephone connector 130 (FIG. 8B). When installing the connector 130, the connector 130 is gripped such that the tab 132 is positioned within the slot 27, thereby facilitating the connector's designed "latch fit" insertion into an appropriate receptacle. Similarly, when removing the connector 130, the tip 18 and 18A (without the slot 27) are positioned so that the tab 132 is depressed to unlatch and free the connector 130 from the receptacle.

It should be appreciated that while serrations 17 have been shown and described, the present invention is not limited in this regard as other gripping means, such as but limited to an elastomeric layer or even a flat surface can be provided without departing from the broader aspect of the present invention. Moreover, while gripping means have been shown and described as being included on tips of both the first and the second jaw portions, the present invention is not limited in this regard as only one of the tips of the jaw portions could include gripping means without departing from the broader aspects of the present invention.

Referring again to FIG. 2, in one embodiment the gripping tool 10 includes a removable light source, shown as a pen light 56. The pen light 56 is disposed between the first and second body members, 12 and 22 respectively so that light emanating therefrom is directed towards the first and second jaw portions, 16 and 26 respectively. In one embodiment, the handle portions 14 and 24 of the gripping tool 10 include limiting means, shown as a screw 25, to restrict the amount by which the first and second jaw portions 16 and 26, respectively, can be brought together in the gripping position. While a screw 25 has been shown and described, the present invention is not limited in this regard as other means can be employed to restrict the amount by which the first and second jaw portions 16 and 26, respectively, can be brought together. For example, a boss or other protuberance projecting outwardly from the second body member 22 can be positioned to contact and stop the movement of the first body member 12.

The foregoing description of embodiments of the invention has been presented for the purpose of illustration and description, it is not intended to be exhaustive or to limit the invention to the form disclosed. Obvious modifications and variations are possible in light of the above disclosure. The embodiments described were chosen to best illustrate the principles of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A gripping tool for installing and removing a connector, the gripping tool comprising:

a first body member formed from a dielectric material, the first body member defining a first jaw portion and a first handle portion, the first jaw portion extending longitudinally outward from the first handle portion and including a first tip;

a second body member formed from a dielectric material, the second body member defining a second jaw portion and a second handle portion, the second jaw portion extending longitudinally outward from the second handle portion and including a second tip;

the first and the second body members are coupled to one another at distal ends of their respective handle portions opposite their respective jaw portions for pivoting movement about an axis between an open position and a gripping position, wherein in the gripping position the body members are in a substantially parallel arrangement; and wherein the first and second tips include gripping means for securely engaging the connector positioned between the first and second jaw portions in response to the first and second body members being moved from the open position to the gripping position.

2. The gripping tool of claim 1 wherein the first and the second jaw portions extend from the respective first and second handle portions in a tapered fashion.

3. The gripping tool of claim 1 wherein the gripping means of at least one of the first and the second tips is a serrated surface.

4. The gripping tool of claim 1 wherein one of the first and second tips includes a slot extending from an end of the jaw portion for receiving a portion of the connector.

5. The gripping tool of claim 1 wherein the first and second tips are removable from the first and second jaw portions.

6. The gripping tool of claim 1 wherein at least one of the first and the second jaw portions further includes a recess portion in proximity to one of the first and the second tips, the recess portion for receiving features of the connector such that the first and the second tips securely hold the connector without interference from the features.

7. The gripping tool of claim 1 further including biasing means for urging at least one of the first and second body members toward the open position.

8. The gripping tool of claim 7 wherein the biasing means includes at least one spring disposed between the first and the second body members.

9. The gripping tool of claim 1 wherein one of the first and second body members includes a pair of generally opposed, outwardly projecting pins and the other of the first and second body portions defines a pair of generally opposed apertures adapted to pivotally receive one of the pins.

10. The gripping tool of claim 1 further comprising a light source retained by at least one of the first and second body portions, the light source being directed toward the first and second jaw portions.

11. The gripping tool of claim 10 wherein the light source is comprised of a pen light removably positioned between the first and second body members.

12. A gripping tool for installing and removing a connector, the gripping tool comprising:

a first body member defining a first jaw portion and a first handle portion, the first jaw portion formed from a dielectric material and extending longitudinally outward from the first handle portion, the first jaw portion including a first tip;

a second body member defining a second jaw portion and a second handle portion, the second jaw portion formed from a dielectric material and extending longitudinally outward from the second handle portion, the second jaw portion including a second tip;

the first and the second body members are coupled to one another at distal ends opposite their respective jaw portions for pivoting movement about an axis between an open position and a gripping position, wherein in the gripping position the body members are in a substantially parallel arrangement; and wherein the first and second tips are removable from the respective first and second jaw portions and wherein at least one of the first and second tips includes gripping means for securely engaging the connector positioned between the first and second jaw portions in response to the first and second body members being moved from the open position to the gripping position.

13. The gripping tool of claim 12 wherein the first and the second jaw portions extend from the respective first and second handle portions in a tapered fashion.

14. The gripping tool of claim 12 wherein the gripping means of the at least one of the first and the second tips is a serrated surface.

15. The gripping tool of claim 12 wherein one of the first and second tips includes a slot extending from an end of the jaw portion for receiving a portion of the connector.

16. The gripping tool of claim 12 wherein at least one of the first and the second jaw portions further includes a recess portion in proximity to one of the first and the second tips, the recess portion for receiving features of the connector such that the first and the second tips securely hold the connector without interference from the features.

17. The gripping tool of claim 12 further comprising a light source retained by at least one of the first and second body portions, the light source being directed toward the first and second jaw portions.

18. A gripping tool for installing and removing a connector, the gripping tool comprising:

a first body member defining a first jaw portion and a first handle portion, the first jaw portion formed from a dielectric material and extending longitudinally outward from the first handle portion, the first jaw portion including a first tip;

a second body member defining a second jaw portion and a second handle portion, the second jaw portion formed from a dielectric material and extending longitudinally outward from the second handle portion, the second jaw portion including a second tip;

the first and the second body members are coupled to one another at distal ends opposite their respective jaw portions for pivoting movement about an axis between an open position and a gripping position;

wherein the first and second tips are removable from the respective first and second jaw portions and wherein at least one of the first and second tips includes gripping means for securely engaging the connector positioned between the first and second jaw portions in response to the first and second body members being moved from the open position to the gripping position; and wherein at least one of the first and the second jaw portions further includes a recess portion in proximity to one of the first and the second tips, the recess portion for receiving features of the connector such that the first and the second tips securely hold the connector without interference from the features.

19. The gripping tool of claim 18 wherein one of the first and second tips includes a slot extending from an end of the jaw portion for receiving a portion of the connector.

20. The gripping tool of claim 18 further comprising a light source retained by at least one of the first and second body portions, the light source being directed toward the first and second jaw portions.

* * * * *